US009855648B2

(12) United States Patent
Herr et al.

(10) Patent No.: US 9,855,648 B2
(45) Date of Patent: Jan. 2, 2018

(54) HAND TOOL DEVICE

(71) Applicant: Robert Bosch GmbH, Stuttgart (DE)

(72) Inventors: Tobias Herr, Stuttgart (DE); Heiko Roehm, Stuttgart (DE); Marco Braun, Stuttgart-Feuerbach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 689 days.

(21) Appl. No.: 14/273,230

(22) Filed: May 8, 2014

(65) Prior Publication Data

US 2014/0338945 A1 Nov. 20, 2014

(30) Foreign Application Priority Data

May 14, 2013 (DE) ..... 10 2013 208 900

(51) Int. Cl.

| | |
|---|---|
| ***B25D 11/10*** | (2006.01) |
| ***B25D 16/00*** | (2006.01) |
| ***B25D 17/00*** | (2006.01) |
| ***B25D 17/06*** | (2006.01) |

(52) U.S. Cl.

CPC ..... *B25D 16/006* (2013.01); *B25D 11/104* (2013.01); *B25D 17/00* (2013.01); *B25D 17/06* (2013.01); *B25D 2216/0023* (2013.01); *B25D 2216/0038* (2013.01); *B25D 2217/0015* (2013.01)

(58) Field of Classification Search

CPC ..... B25D 11/102; B25D 11/104; B25D 2216/00; B25D 2211/062

USPC ..... 173/118, 202, 203

See application file for complete search history.

(56) References Cited

U.S. PATENT DOCUMENTS

| | | | | |
|---|---|---|---|---|
| 1,511,566 | A * | 10/1924 | Kollock | B25D 11/102 173/203 |
| 3,685,594 | A * | 8/1972 | Koehler | B25D 11/108 173/109 |
| 4,073,348 | A * | 2/1978 | Schramm | B25D 11/102 173/109 |
| 4,428,439 | A * | 1/1984 | Moreno | B25D 11/102 173/118 |
| 5,277,259 | A * | 1/1994 | Schmid | B25D 11/005 173/109 |
| 7,032,687 | B2 * | 4/2006 | Rask | B25D 11/102 173/203 |
| 2014/0338944 | A1 * | 11/2014 | Herr | B25D 17/00 173/94 |

FOREIGN PATENT DOCUMENTS

| | | |
|---|---|---|
| CN | 1891408 A | 1/2001 |
| CN | 1522818 A | 8/2004 |
| CN | 1550296 A | 12/2004 |

* cited by examiner

*Primary Examiner* — Thanh Truong
*Assistant Examiner* — Patrick Fry
(74) *Attorney, Agent, or Firm* — Norton Rose Fulbright US LLP; Gerard Messina

(57) ABSTRACT

A hand tool device has a hammer mechanism including a hammer, at least one curve guide which drives the hammer at least during the hammer drilling operation, and at least one hammer mechanism spring which (i) stores at least a part of an impact energy in at least one operating state, and (ii) holds the hammer in the peripheral direction in at least one operating state.

14 Claims, 15 Drawing Sheets

A - A

B - B

C - C

D - D

E - E

F - F

G - G

H - H

I - I

J - J

HAND TOOL DEVICE

BACKGROUND OF THE INVENTION

1. Field of the Invention

The present invention relates to a hand tool device which has a tool spindle and a hammer mechanism.

2. Description of the Related Art

A hand tool device has already been proposed which has a hammer mechanism including a hammer, at least one curve guide, which drives the hammer at least during the hammer drilling operation, and at least one hammer mechanism spring which stores at least a part of an impact energy in at least one operating state.

BRIEF SUMMARY OF THE INVENTION

The present invention is directed to a hand tool device which has a hammer mechanism including a hammer, at least one curve guide, which drives the hammer at least during a hammer drilling operation, and at least one hammer mechanism spring which stores at least a part of an impact energy in at least one operating state.

It is proposed that the hammer mechanism spring holds the hammer in the peripheral direction in at least one operating state. A "hammer mechanism" is, in particular, to be understood to mean a device which is provided to generate an impact momentum and to output it, in particular, in the direction of an insert tool. Preferably, the hammer mechanism advantageously relays the impact momentum to the insert tool via a tool spindle and/or in particular via an insert tool holding fixture of the hand tool device at least during a hammer drilling operation. The hammer mechanism is preferably provided to convert a rotational movement into a translatory hammer movement, in particular. In particular, the hammer mechanism is not designed as a ratchet-controlled hammer mechanism. The term "provided" is, in particular, to be understood to mean specially programmed, designed and/or equipped. In particular, the term "hammer" is to be understood to mean a means which is, in particular, at least essentially accelerated in a translatory manner at least during the hammer drilling operation and which outputs a momentum, which it acquired during the acceleration, as an impact momentum in the direction of the insert tool. The hammer is preferably designed as one piece. Alternatively, the hammer may also have a multi-part design. In particular, a "curve guide" is to be understood to mean a device which converts a kinetic energy of rotation for an impact generation into a linear kinetic energy of the hammer at least with the aid of a specially formed guiding area along which a connecting means runs at least during a hammer drilling operation. The hammer mechanism preferably has a hammer mechanism spring which stores the linear kinetic energy of the hammer for impact generation. The specially formed area is preferably an area which delimits a guiding curve of the curve guide. The curve guide is preferably provided to induce the hammer once to an impact during one rotation of a hammer mechanism spindle of the hand tool device. Alternatively, the curve guide may also be provided to induce the hammer to at least two or advantageously three impacts during one rotation of the hammer mechanism spindle. In this case, a hammer mechanism transmission might be dispensed with. The curve guide preferably subjects the hammer to a force which points away from the insert tool holding fixture. A "connecting means" is, in particular, to be understood to mean a means which establishes a mechanical coupling between at least one part of the hammer mechanism, in particular a hammer mechanism spindle which moves rotatingly during a hammer drilling operation, and the hammer which moves linearly, in particular. The connecting means is preferably designed as a sphere. Alternatively, the connecting means may also have a different shape which appears to be reasonable to those skilled in the art. The connecting means preferably has a diameter which is greater than 4 mm, advantageously greater than 5 mm, and particularly advantageously greater than 6 mm. The connecting means preferably has a diameter which is smaller than 14 mm, advantageously smaller than 10 mm, and particularly advantageously smaller than 8 mm. In particular, a "guiding curve" is to be understood to mean an area which is delimited by the guiding area in which the connecting means runs in at least one operating state. The hammer mechanism preferably has exactly the one curve guide having exactly the one guiding curve and at least the one connecting means. Alternatively, the hammer mechanism might have two or, in particular, more than two guiding curves, each having exactly one curve guide and at least one connecting means. A "hammer drilling operation" is, in particular, to be understood to mean an operation of the hand tool device during which the insert tool is rotatably and percussively driven, while work is being done on a workpiece. A "hammer mechanism spring" is, in particular, to be understood to mean a spring which subjects the hammer to a force in the impact direction in at least one operating state. In particular, an "impact energy" is to be understood to mean an energy which accelerates the hammer in the impact direction prior to an impact. In this context, "storing" is, in particular, to be understood to mean that the hammer mechanism spring absorbs the impact energy at a point in time and releases it to the hammer, in particular by accelerating the hammer, at a later point in time. The curve guide preferably tensions the hammer mechanism spring. In particular, the phrase "fastened in the peripheral direction" is to be understood to mean that the hammer mechanism spring subjects the hammer in at least one operating state to a force which counteracts a force which acts on the hammer in the peripheral direction and which, in particular, causes the curve guide. The fastening of the hammer with the aid of the hammer mechanism spring preferably prevents the hammer from moving about an axis of rotation of the hammer mechanism spindle by more than 360 degrees, advantageously from moving by more than 180 degrees, and particularly advantageously from moving by more than 90 degrees. "A force acting in the peripheral direction" is, in particular, to be understood to mean a force which has at least one component which is oriented vertically in relation to an axis of rotation of a hammer mechanism spindle of the hammer mechanism and which effectuates a torque relative to the peripheral direction of the hammer mechanism spindle. With the aid of the embodiment according to the present invention of the hand tool device, a particularly cost-effective, lightweight, and space-saving construction may be achieved. In particular, a separate fastening of the hammer may be dispensed with.

In another embodiment, it is proposed that the hammer mechanism spring holds the hammer in the case of a clockwise rotation in the peripheral direction, whereby a clockwise percussive operation may be advantageously achieved. A "clockwise rotation" is, in particular, to be understood to mean an operating state during which the insert tool holding fixture, viewed in the impact direction, is driven clockwise. Preferably, the hammer mechanism spindle of the hand tool rotates in the same direction of rotation as the insert tool holding fixture at least during a hammer drilling operation. Alternatively, the hammer mechanism spindle may also rotate in a different direction of rotation than the insert tool holding fixture during a hammer drilling operation. Those skilled in the art would adjust the fastening of the hammer with the aid of the hammer mechanism spring to the direction of rotation of the hammer mechanism spindle. A "counterclockwise rotation" is, in particular, to be understood to mean an operating state during which the insert tool holding fixture, viewed in the impact direction, is driven counterclockwise. An "impact direction" is, in particular, to be understood to mean a direction which runs in parallel to an axis of rotation of the insert tool holding fixture and which points from the hammer in the direction of the insert tool holding fixture.

Furthermore, it is proposed that the hammer has a catching means which is subjected to the hammer mechanism spring in the case of a clockwise rotation in the peripheral direction, thus making a particularly simple construction possible. A "catching means" is, in particular, to be understood to mean a means which is provided to catch the hammer from an initial rotary motion during a clockwise rotation and to establish a rotatably fixed connection.

It is furthermore proposed that the catching means and the hammer mechanism spring have a form fit during the clockwise rotation in the peripheral direction, whereby a reliable fastening of the hammer may be achieved during the percussive operation. A "form-locked connection" is, in particular, to be understood to mean a geometric intervention of the catching means into the hammer mechanism spring, thus counteracting a rotary motion of the hammer.

In addition, it is proposed that the hammer has at least essentially a free wheel during a counterclockwise rotation, in particular at least in relation to a hand tool housing of the hand tool device and advantageously in relation to the hammer mechanism spring. In particular, "having a free wheel" is to be understood to mean in this context that a rotation of the hammer mechanism spindle causes a rotation of the hammer during a counterclockwise rotation, whereby the hammer is advantageously essentially prevented from impacting. In this context, "essentially" is, in particular, to be understood to mean that the hammer releases during a hammer drilling operation in the case of the counterclockwise rotation of the insert tool holding fixture an impact energy which corresponds to less than 50%, advantageously less than 25%, of an impact energy which is released by the hammer at the same speed in the case of the clockwise rotation of the insert tool holding fixture. Due to the free wheel during the counterclockwise rotation, a separate hammer mechanism deactivation may be dispensed with during the counterclockwise rotation. In this way, a particularly cost-effective, lightweight, and space-saving construction is possible.

Furthermore, it is proposed that the hammer has at least one part of the curve guide, thus allowing for particularly small overall size. The phrase that "the hammer has at least one part of the curve guide" is, in particular, to be understood to mean that the hammer has an area onto which the connecting means directly transfers the energy in order to generate the percussion movement. Preferably, the part of the curve guide, which the hammer has, is designed as an area which fixes the connecting means in place in relation to the hammer. Advantageously, the part of the curve guide, which the hammer has, includes a fastening recess which is delimited by the area which fixes the connecting means in place in relation to the hammer. Advantageously, the hammer is provided to hold the connecting means which connects during operation that part of the curve guide and another part of the curve guide, in particular the guiding curve. The connecting means and the hammer are preferably connected without the use of a spring. This means, in particular, that a spring is not operatively situated between the connecting means and the hammer. Alternatively, the connecting means might be designed, at least partially, in one piece with the hammer. Furthermore, the part of the curve guide, which the hammer has, might alternatively be designed as a guiding curve. "Fixed in place" is, in particular, to be understood to mean that an axis of symmetry and/or a central point of the connecting means is essentially immovable in relation to the hammer during a percussive operation.

In one advantageous embodiment of the present invention, it is proposed that the hand tool device has a tool spindle which has at least one bearing surface on which the hammer is supported, in particular, movably in the axial direction in at least one operating state, whereby a mounting of the hammer may be achieved which is particularly low in friction and wear. A "tool spindle" is, in particular, to be understood to mean a shaft which transfers a rotational movement from the transmission to the insert tool holding fixture. The bearing surface preferably subjects the hammer to a bearing force which is oriented in a radial direction. During the hammer drilling operation, the hammer is preferably moved in an essentially translatory manner in the impact direction, while the tool spindle is rotatably driven during the hammer drilling operation. The tool spindle is preferably designed as a solid shaft. Alternatively, the tool spindle might be designed as a hollow shaft. In particular, a "bearing surface" is to be understood to mean a surface which subjects the hammer during an operation to a bearing force vertically to the surface and allows the hammer to move in parallel to the surface.

In another embodiment, it is proposed that the hammer mechanism includes a hammer mechanism spindle having a bearing surface on which the hammer is movably supported in at least one operating state, thus making a particularly compact design possible. A "hammer mechanism spindle" is, in particular, to be understood to mean a shaft which directly transfers a rotational movement to the at least one area of the curve guide at least during one hammer drilling operation. The hammer mechanism spindle is preferably rotatably fixedly connected to at least one area of the curve guide, in particular a fastening means of the curve guide, which guides the connecting means of the curve guide, in particular, on a circular trajectory. The hammer mechanism spindle advantageously transfers the rotational movement to the curve guide separately from a rotational movement which drives the insert tool holding fixture. In particular, the hammer mechanism spindle is implemented separately from the tool spindle. The hammer mechanism spindle is preferably designed as a hollow shaft.

Furthermore, it is proposed that the tool spindle has at least one impact surface which the hammer impacts at least during a hammer drilling operation, whereby a particularly simple construction may be achieved. An "impact surface" is, in particular, to be understood to mean a surface of the tool spindle through which the hammer transfers the impact momentum to the tool spindle in at least one operating state. The hammer preferably impacts the tool spindle directly. Alternatively, the hammer might impact the tool spindle via a snap die.

The hand tool device according to the present invention is not to be limited to the application and specific embodiment described above. In particular, the hand tool device according to the present invention may have a number of individual elements, components, and units which deviate from the number mentioned herein for the purpose of fulfilling a functionality described herein.

DETAILED DESCRIPTION OF THE INVENTION

Figure 1:
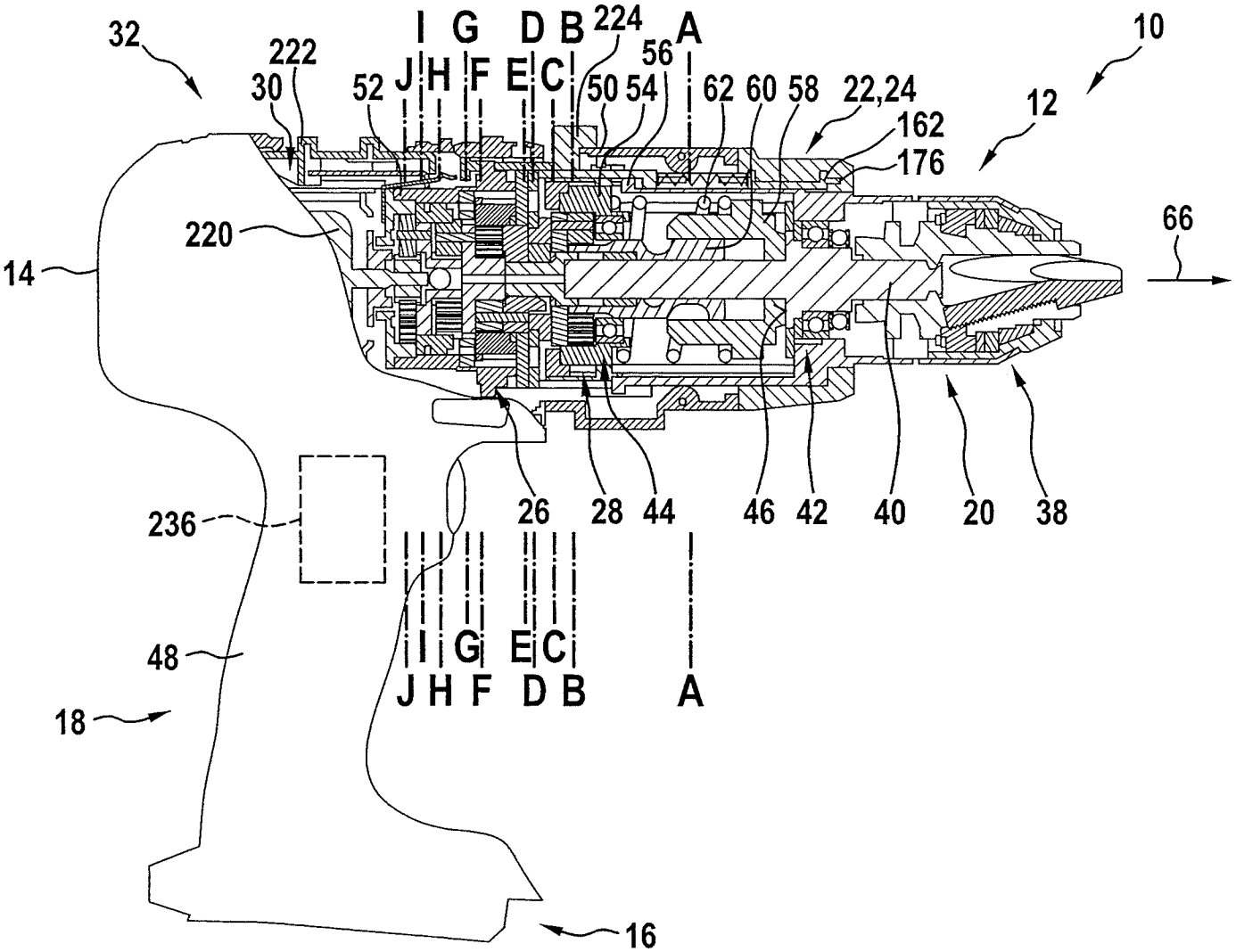
FIG. 1 shows a section of a hand tool having a hand tool device according to the present invention.

FIG. 1 shows a hand tool 10. Hand tool 10 is designed as a cordless impact combi drill. Hand tool 10 has a hand tool device 12 according to the present invention, a hand tool housing 14, and a battery interface 16. Battery interface 16 is provided to supply hand tool device 12 with electrical energy from a hand tool battery which is not illustrated here in greater detail. Hand tool housing 14 is essentially designed in the shape of a pistol. It includes a handle 18 with the aid of which an operator holds hand tool 10 during operation. Hand tool device 12 includes a tool guiding unit 20, a hammer mechanism 22, an impact deactivation device 24, a transmission 26, a hammer mechanism transmission 28, a drive unit 30, an operating device 32, a torque limiting unit 34, and a spindle blocking device 36. Drive unit 30 is designed as an electric motor. Transmission 26 is provided to reduce a speed of drive unit 30. In addition, transmission 26 is provided to make available at least two different gear ratios.

A gripping surface of handle 18 is essentially designed vertically in relation to an axis of rotation of tool guiding unit 20. Hand tool housing 14 has an overhang with respect to handle 18 on a side facing away from tool guiding unit 20. This means that a basic shape of hand tool housing 14 is a T shape.

Tool guiding unit 20 includes an insert tool holding fixture 38 and a tool spindle 40. Insert tool holding fixture 38 and tool spindle 40 are screwed to one another. Alternatively, insert tool holding fixture 38 and tool spindle 40 might be detachably connected without the use of tools in a manner which appears reasonable to those skilled in the art. Insert tool holding fixture 38 holds during operation an insert tool, e.g., a drill bit or a screwdriver bit, which is not illustrated here. Insert tool holding fixture 38 holds the insert tool in a force-fitted manner. Alternatively or additionally, an insert tool holding fixture might hold the insert tool in a form-locked manner, for example, with the aid of an SDS tool chuck or a hexagonal receptacle. Insert tool holding fixture 38 has three chuck jaws which are fastened in such a way that they may be moved by an operator and which hold the insert tool during operation. In addition, insert tool holding fixture 38 holds the insert tool during operation axially immovably with respect to insert tool holding fixture 38 and, in particular, with respect to tool spindle 40. A part of insert tool holding fixture 38 and tool spindle 40 are immovably connected in relation to one another. In this case, insert tool holding fixture 38 and tool spindle 40 are screwed to one another.

Hand tool device 12 has a bearing means 42 on which tool spindle 40 is supported on a side facing insert tool holding fixture 38. Tool spindle 40 is axially displaceably supported on bearing means 42. Bearing means 42 is axially fixedly connected to tool spindle 40. Bearing means 42 is axially movably supported in hand tool housing 14. Hand tool device 12 has a further bearing means 44 on which tool spindle 40 is supported on a side facing transmission 26. Bearing means 44 is designed as a friction bearing. Tool spindle 40 is axially displaceably supported on bearing means 44. Tool spindle 40 includes an impact surface 46 which hammer mechanism 22 strikes during an illustrated hammer drilling operation.

Hand tool housing 14 has a multi-part design. Hand tool housing 14 includes a two-shell handle and drive housing 48, a two-shell outer housing 50, a transmission housing 52, a hammer mechanism transmission housing 54, and a hammer mechanism housing 56. These parts of hand tool housing 14 are produced separately from one another. Handle and drive housing 48 forms handle 18 and encloses drive unit 30. Outer housing 50 encloses transmission housing 52 and hammer mechanism transmission housing 54. In addition, outer housing 50 fastens transmission housing 52, hammer mechanism transmission housing 54, and hammer mechanism housing 56 to handle and drive housing 48 in a form-locked manner. Transmission housing 52 encloses transmission 26. It has a tubular design. Hammer mechanism transmission housing 54 encloses hammer mechanism transmission 28. Hammer mechanism housing 56 encloses hammer mechanism 22. It also has a tubular design.

Figure 2:
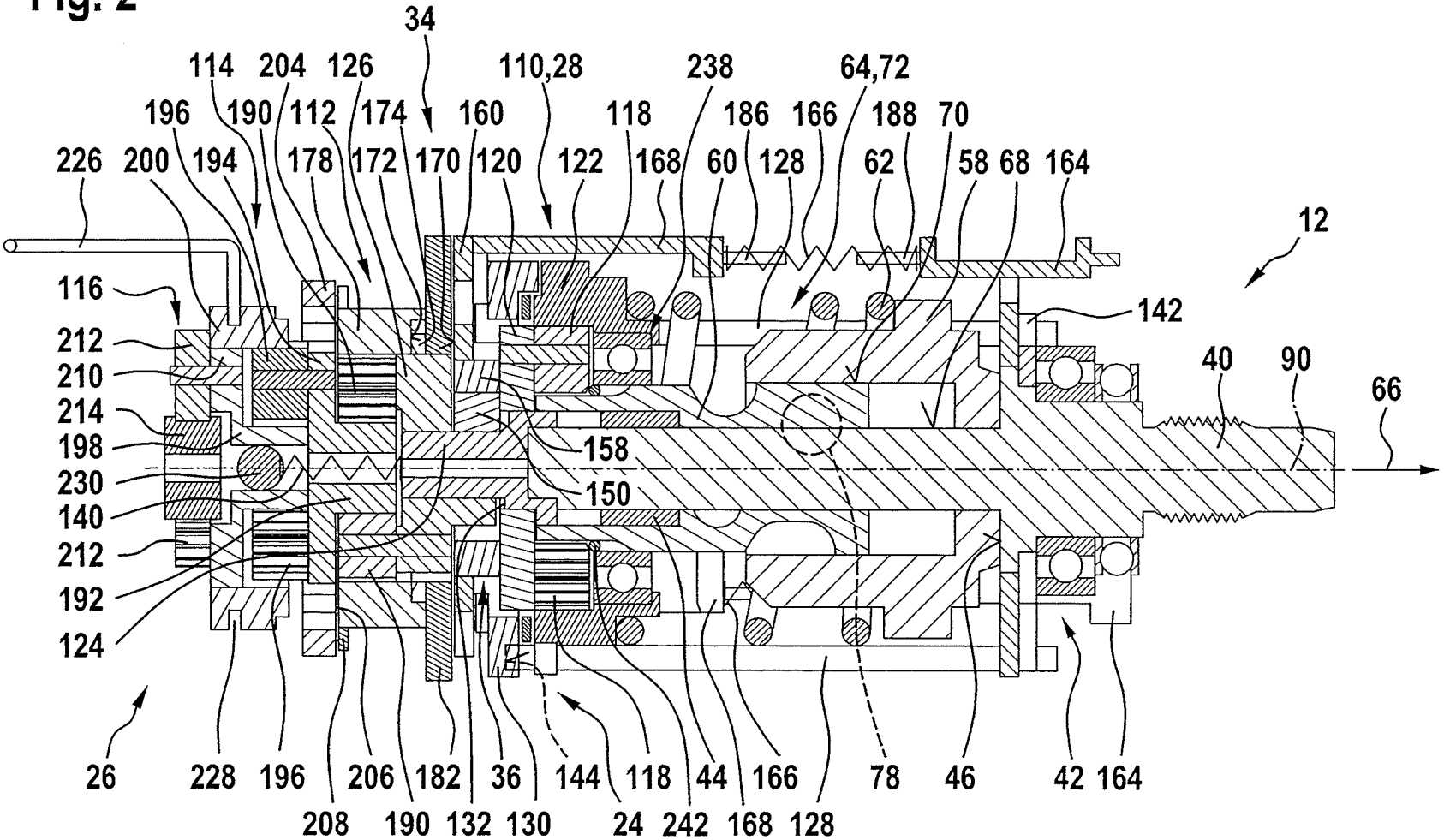
FIG. 2 shows a partially exposed section through a hammer mechanism and a planetary gear of the hand tool device from FIG. 1.

FIG. 2 shows hammer mechanism 22 and transmission 26, hammer mechanism transmission 28, torque limiting unit 34, and spindle blocking device 36 in greater detail. Hammer mechanism 22 is switchable into an activated and a deactivated operating state. Hammer mechanism 22 has a hammer 58, an hammer mechanism spindle 60, an hammer mechanism spring 62, and a hammer driving device 64. Hammer mechanism spindle 60 encloses bearing means 44 on which tool spindle 40 is supported on a side facing transmission 26. Bearing means 44 is operatively situated between tool spindle 40 and hammer mechanism spindle 60. Hammer 58 is supported in an impact direction 66 translatorily movably. Impact direction 66 is oriented in parallel to an axial direction of hammer mechanism spindle 60.

Tool spindle 40 and hammer mechanism spindle 60 each have a bearing surface 68 and 70, respectively, on which hammer 58 is movably supported. Bearing surfaces 68, 70 act directly on hammer 58. Bearing surfaces 68, 70 are lateral surfaces of tool spindle 40 and hammer mechanism spindle 60, respectively. Alternatively, hammer 58 might also be supported only on tool spindle 40 or on hammer mechanism spindle 60 and on an outer surface of hammer 58, if necessary. An inner surface of hammer 58 delimits an inner space which is inwardly constricting in impact direction 66. Bearing surface 68 of tool spindle 40 acts on a constricted area of the inner surface of hammer 58. Bearing surface 70 of hammer mechanism spindle 60 acts on an unconstricted area of the inner surface of hammer 58 which faces transmission 26. Hammer 58 has a pot-shaped basic shape, a recess, through which tool spindle 40 runs, being situated in the bottom of the pot-shaped basic shape. Hammer 58 strikes tool spindle 40 with a bottom outer surface of the pot-shaped basic shape during operation. Hammer 58 encloses tool spindle 40 and hammer mechanism spindle 60 on at least one plane which is oriented vertically to impact direction 66 by 360 degrees.

Alternatively, a hammer mechanism might have a hammer and a hammer mechanism spindle, the hammer mechanism spindle enclosing the hammer. In this case, a curve guide of the hammer mechanism would be situated on an outer surface of the hammer. Here, either the hammer or the hammer mechanism spindle might have a guiding curve of the curve guide. Due to a larger radius of the curve guide, it would be advantageous in this case if the curve guide were provided to induce the hammer to an impact multiple times during one rotation.

Figure 3:
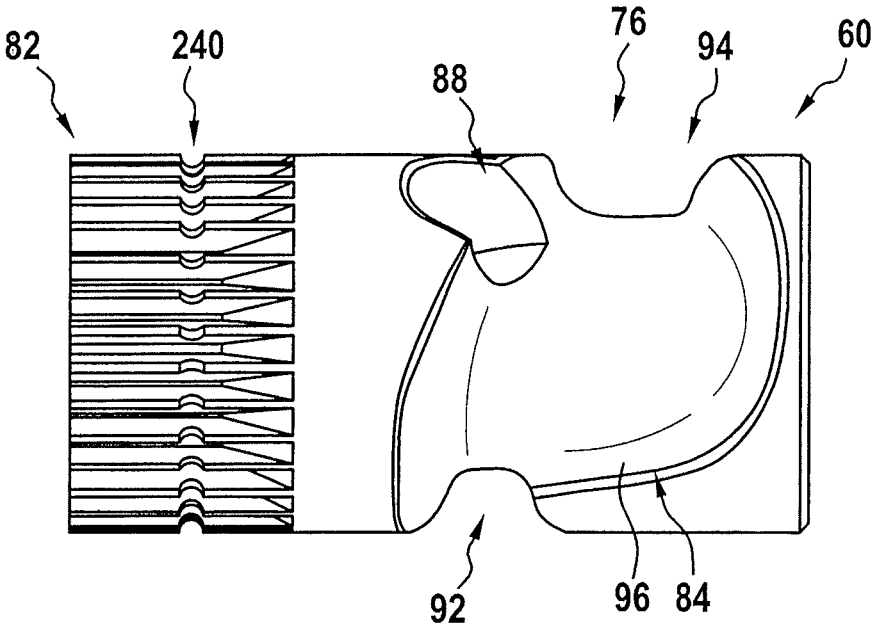
FIG. 3 shows a first side view of a hammer of the hammer mechanism of the hand tool device from FIG. 1.
Figure 4:
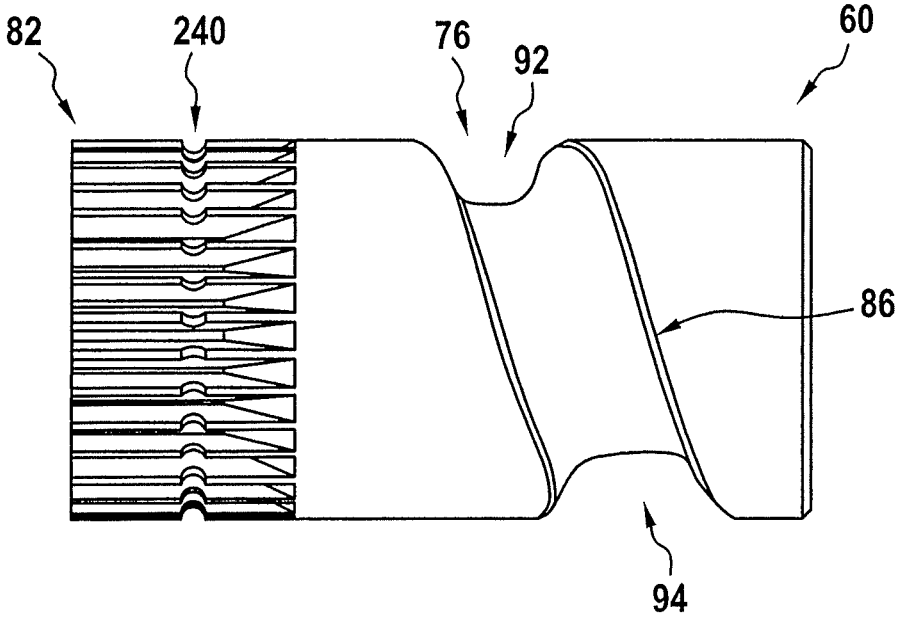
FIG. 4 shows a second side view of the hammer from FIG. 3 from an opposite side.
Figure 5:
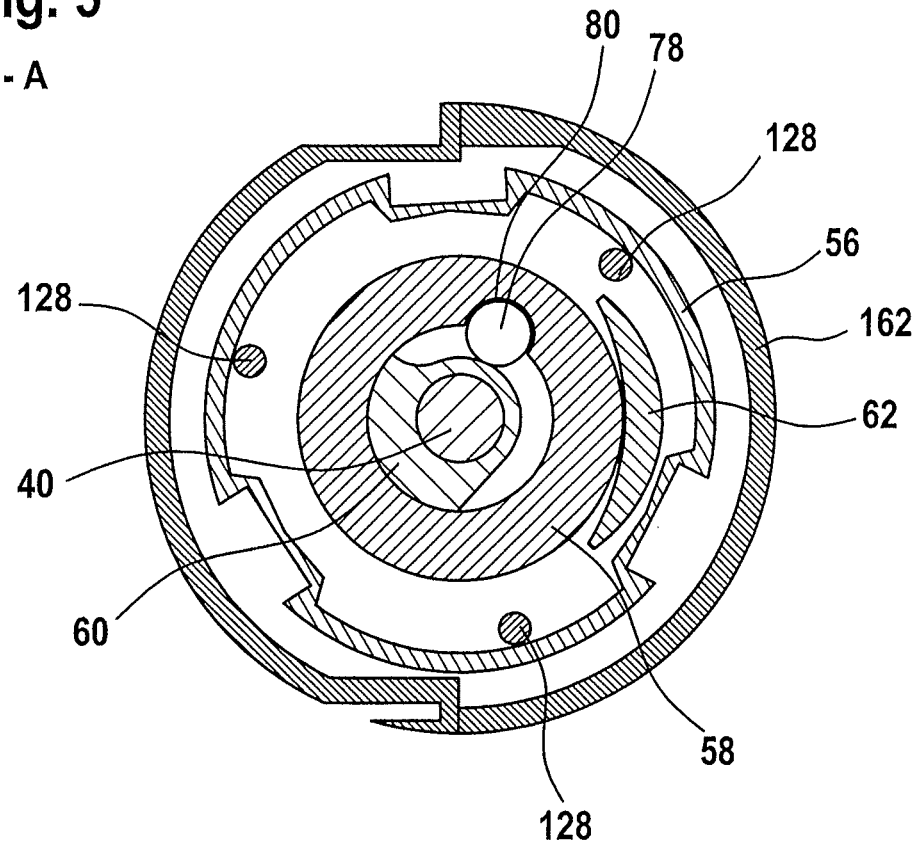
FIG. 5 shows a first section area A of the hammer mechanism of the hand tool device from FIG. 1.

FIGS. 3 and 4 show hammer mechanism spindle 60 in two side views which differ by 180 degrees. FIG. 5 shows a section area A of hammer driving device 64. Hammer driving device 64 has exactly one curve guide 72. Curve guide 72 includes a guiding curve 76, a connecting means 78, and a fastening means 80. Curve guide 72 is situated on hammer mechanism spindle 60. Alternatively, at least one curve guide might be situated on a hammer. Fastening means 80 is situated on hammer 58. Hammer 58 thus has a part of curve guide 72. Alternatively, at least one fastening means might be situated on a hammer mechanism spindle.

Fastening means 80 is designed as a fastening recess for connecting means 78. Fastening means 80 is situated on an inner surface of hammer 58. Fastening means 80 is introduced into the inner surface of hammer 58 with the aid of a bore through a side of hammer 58 which faces away from the fastening means. Connecting means 78 is designed as a sphere. Connecting means 78 has a diameter of 7 mm. Fastening means 80 fixedly supports connecting means 78 in relation to hammer 58.

Connecting means 78 slides in guiding curve 76 during the hammer drilling operation. Hammer mechanism spindle 60 delimits a space in which connecting means 78 moves during the hammer drilling operation.

Hammer mechanism spindle 60 is designed as a hollow shaft. Hammer mechanism spindle 60 is rotatably supported in hand tool housing 14 on a side which faces away from insert tool holding fixture 38. Hammer mechanism transmission 28 drives hammer mechanism spindle 60. For this purpose, hammer mechanism spindle 60 has a toothing 82 on a side which faces away from insert tool holding fixture 38. Guiding curve 76 has an impact free-wheel area 84, an impact elevator area 86, and an assembly recess 88. During an assembly, connecting means 78 is introduced through assembly recess 88 into fastening means 80 of hammer 58. Hammer mechanism spindle 60 rotates clockwise, viewed in impact direction 66, during the hammer drilling operation. Impact elevator area 86 has a spiral-shaped design. It extends by approximately 180 degrees about an axis of rotation 90 of hammer mechanism spindle 60. Impact elevator area 86 moves connecting means 78 and thus hammer 58 against impact direction 66 during the hammer drilling operation.

Impact free-wheel area 84 connects two ends 92, 94 of impact elevator area 86. Impact free-wheel area 84 extends by approximately 180 degrees about an axis of rotation 90 of hammer mechanism spindle 60. Impact free-wheel area 84 has an impact edge 96 which runs approximately in parallel to impact direction 66 starting from end 92 of impact elevator area 86, which faces transmission 26. As soon as connecting means 78 enters impact free-wheel area 84, hammer mechanism spring 62 accelerates hammer 58 and connecting means 78 in impact direction 66. In this case, connecting means 78 moves through impact free-wheel area 84, without being acted on by an axial force, until hammer 58 strikes impact surface 46. Therefore, hammer mechanism spring 62 stores in at least one operating state at least a part of an impact energy which hammer 58 transfers to tool spindle 40 during an impact.

Figure 6:
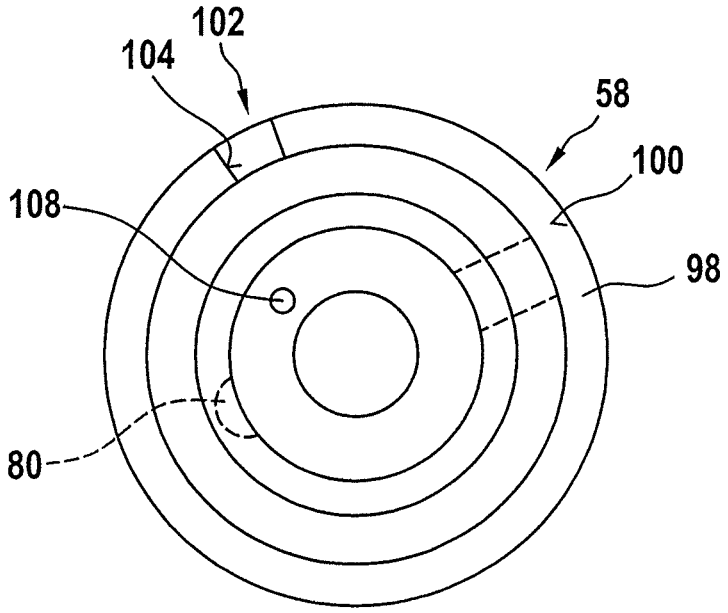
FIG. 6 shows the hammer from FIG. 3 viewed in the impact direction.
Figure 7:
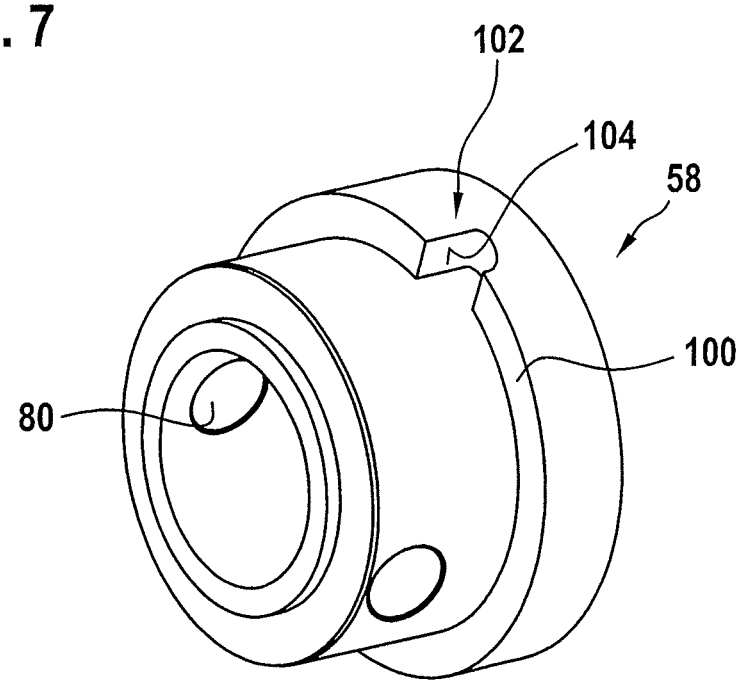
FIG. 7 shows the hammer from FIG. 3 in a perspective view.

FIGS. 6 and 7 show hammer 58. Hammer mechanism spring 62 accelerates hammer 58 in impact direction 66 prior to an impact. For this purpose, hand tool housing 14 supports hammer mechanism spring 62 on a side which faces away from hammer 58. Hammer mechanism spring 62 presses directly against hammer 58. An essentially circular or spiral-shaped surface 100 of a circular molding 98 to the basic shape of hammer 58 supports hammer mechanism spring 62. Hammer mechanism spring 62 encloses a part of hammer 58. Hammer mechanism spring 62 holds hammer 58 during the hammer drilling operation in the peripheral direction.

Hammer 58 has a catching means 102 which is acted on by hammer mechanism spring 62 in the case of a clockwise rotation of insert tool holding fixture 38 during a hammer drilling operation in the peripheral direction. In the case of a clockwise rotation of insert tool holding fixture 38, hammer mechanism spindle 60 also rotates clockwise, viewed in impact direction 66, in this exemplary embodiment. It is apparent to those skilled in the art to adjust catching means 102 to a hammer mechanism spindle 60 which rotates counterclockwise.

Catching means 102 has a ratchet surface 104 which is oriented at least essentially vertically to surface 100 of molding 98 and on which hammer mechanism spring 62 presses to accelerate hammer 58. Surface 100 on which hammer mechanism spring 62 presses to accelerate hammer 58 is designed in the shape of a ramp and tilted in relation to impact direction 66. In the case of the clockwise rotation of insert tool holding fixture 38, hammer mechanism spring 62 acts on ratchet surface 104 and connects hammer 58 and hammer mechanism spring 62 in a form-locked manner in the peripheral direction. In the case of the counterclockwise rotation of insert tool holding fixture 38, hammer mechanism spring 62 slides over ratchet surface 104. In this way, hammer 58 and hammer mechanism spring 62 have a free wheel in the peripheral direction with respect to one another during the counterclockwise rotation of insert tool holding fixture 38. Alternatively, hammer mechanism spring 62 might always be rotatably fixedly connected to hammer 58, and hammer mechanism spring 62 might have a free wheel with respect to hand tool housing 14 during the counterclockwise rotation.

Figure 8:
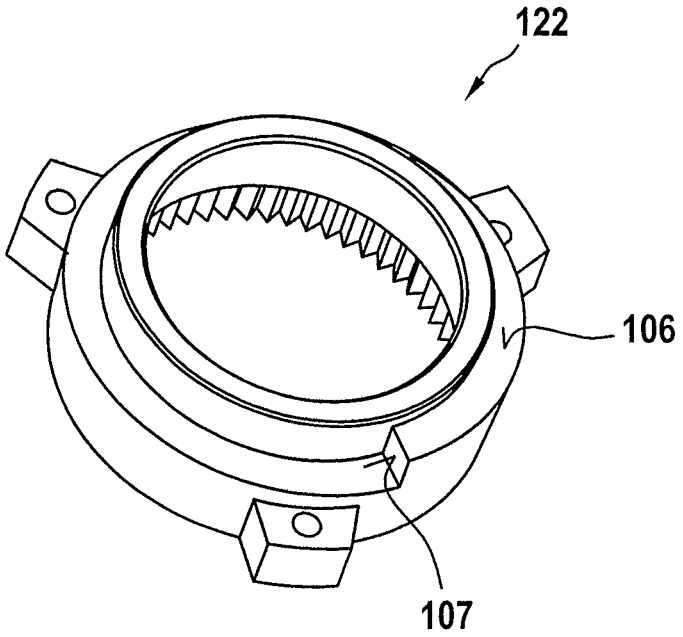
FIG. 8 shows the hammer from FIG. 3 viewed in the impact direction.

As FIG. 8 shows, a component of hand tool 10 which is rotatably fixedly connected to hand tool housing 14 and which has an annulus gear 122 in this case, as an example, has an essentially circular or spiral-shaped surface 106 which supports hammer mechanism spring 62 in a direction which is oriented against impact direction 66. Surface 106 is interrupted by a ratchet surface 107 which is oriented essentially vertically to surface 106 of the component. Ratchet surface 107 is provided for the purpose of applying a force, which counteracts a movement of hammer 58, in the peripheral direction to hammer mechanism spring 62 in the case of the clockwise rotation of insert tool holding fixture 38. In this way, ratchet surface 107 connects hand tool housing 14 and hammer mechanism spring 62 in the peripheral direction in a form-locked manner in the case of the clockwise rotation of insert tool holding fixture 38. Alternatively, hammer mechanism spring 62 might also be rotatably fixedly connected to hand tool housing 14 on a side facing away from hammer 58, for example in that one end of a wire which forms hammer mechanism spring 62 is bent in such a way that it sticks out in the direction of drive unit 30. Furthermore, as an alternative to the above-described component having an annulus gear 122, another component, which appears reasonable to those skilled in the art, might include ratchet surface 107, e.g., a housing part of hand tool housing 14.

Hammer 58 has a ventilation opening 108 through which air may escape from a space which is delimited by tool spindle 40, hammer mechanism spindle 60, and hammer 58 and/or flow into this space during a movement of hammer 58.

Hammer mechanism transmission 28 is situated between transmission 26 and hammer mechanism 22. Hammer mechanism transmission 28 has a first planetary gear stage 110. Transmission 26 has a second planetary gear stage 112, a third planetary gear stage 114, and a fourth planetary gear stage 116.

Figure 9:
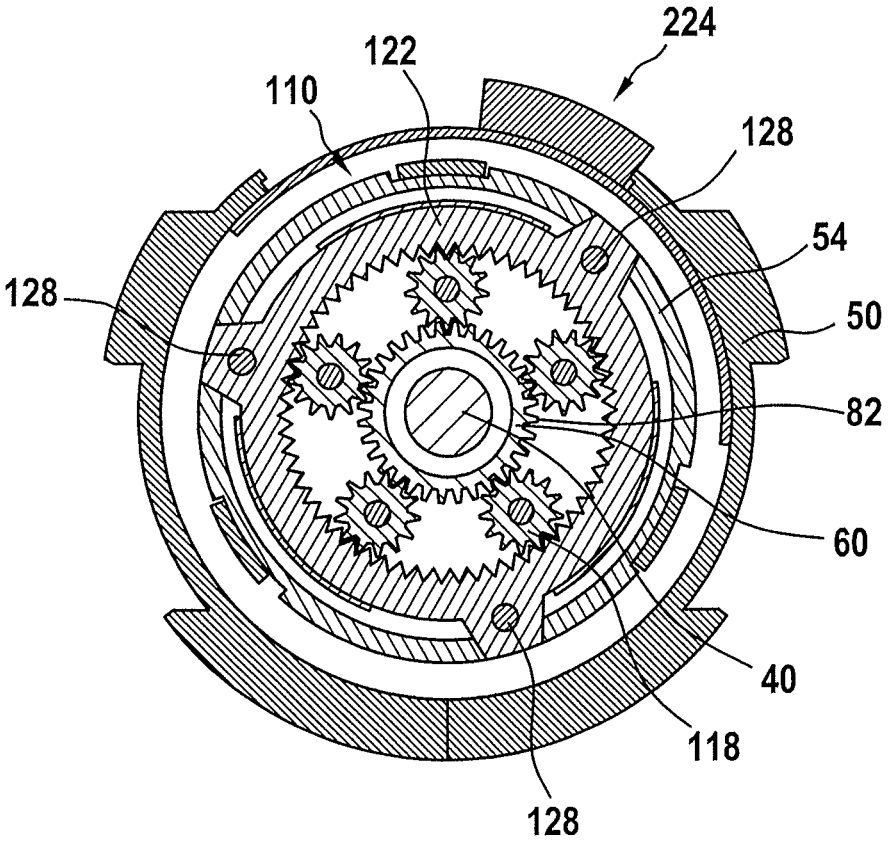
FIG. 9 shows a section area B through a first planetary gear stage of the hand tool device from FIG. 1.

FIG. 9 shows a section area B of first planetary gear stage 110. First planetary gear stage 110 increases a first rotational speed of second planetary gear stage 112 for driving hammer mechanism 22. Second planetary gear stage 114 drives tool spindle 40 at this first rotational speed. Toothing 82 of hammer mechanism spindle 60 forms a sunwheel of first planetary gear stage 110. Toothing 82 meshes with planetary wheels 118 of first planetary gear stage 110 which are guided by a planet carrier 120 of first planetary gear stage 110. Annulus gear 122 of first planetary gear stage 110 meshes with planetary wheels 118 of first planetary gear stage 110. Annulus gear 122 is rotatably fixedly connected to hand tool housing 14.

Impact deactivation device 24 is provided to deactivate hammer mechanism 22 during a screw-driving operation, a drilling operation, and in the hammer drilling mode, if the insert tool is unloaded. Impact deactivation device 24 has three transfer means 128, a control element 130, and an impact deactivation clutch 132.

Figure 10:
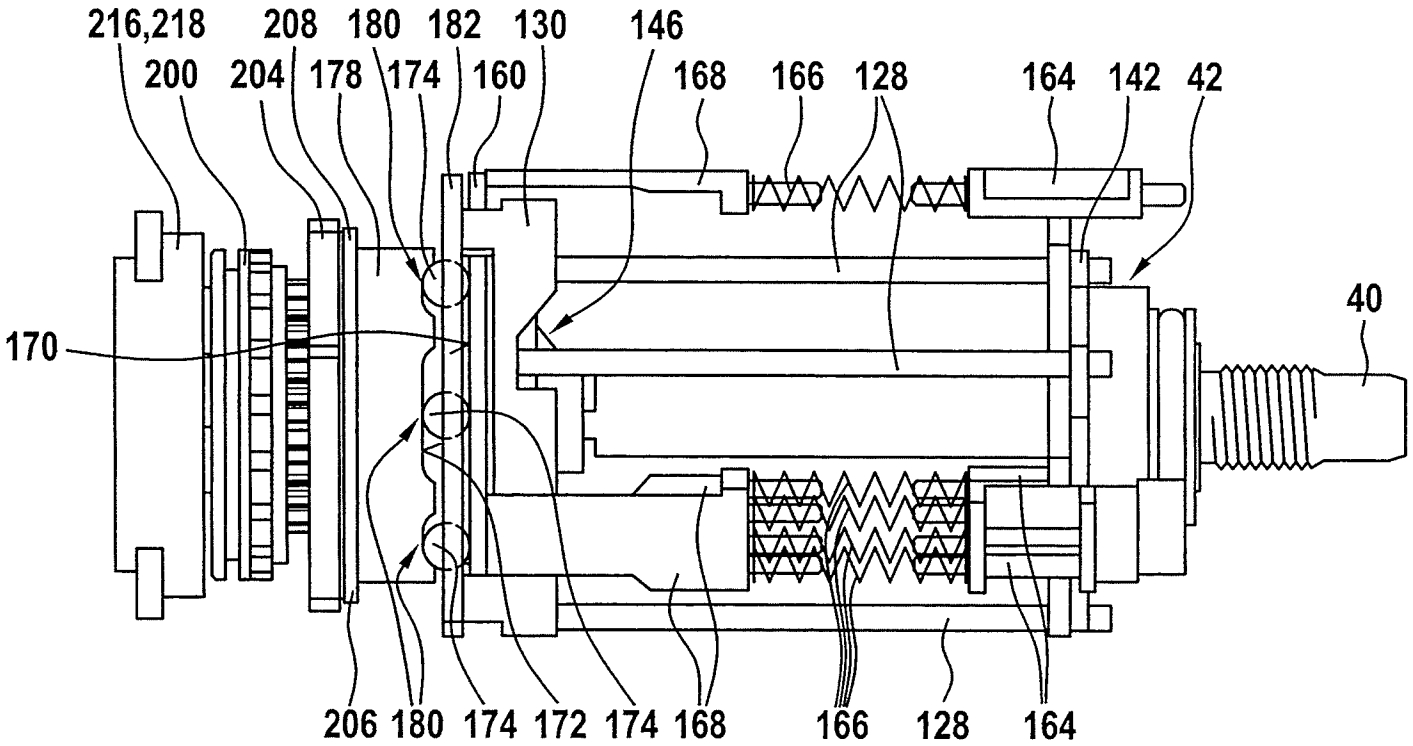
FIG. 10 shows a partially exposed side view of a part of the hand tool device from FIG. 1.
Figure 11:
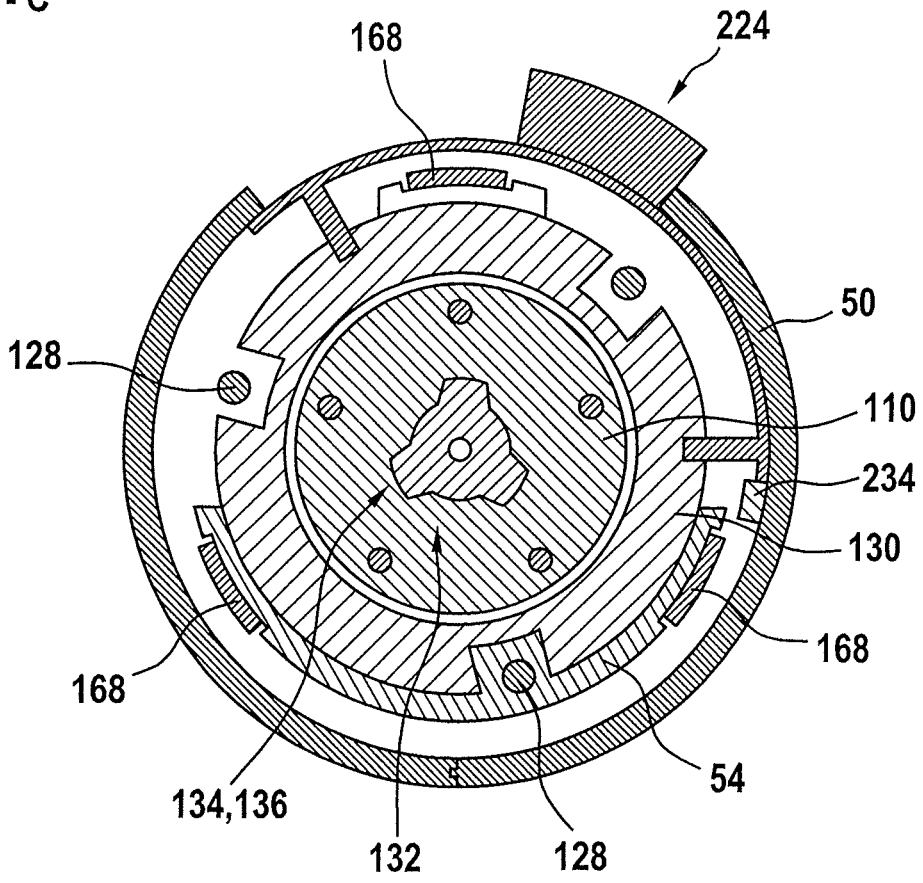
FIG. 11 shows a section area C through a control element of an impact deactivation device of the hand tool device from FIG. 1.

FIG. 10 shows an exposed side view of impact deactivation device 24. FIG. 11 shows a section area C through control element 130 of impact deactivation device 24. Furthermore, FIG. 11 shows a connecting means 124 which rotatably fixedly connects tool spindle 40 and a planet carrier 126 of second planetary gear stage 112. Connecting means 124 connects tool spindle 40 and planet carrier 126 of second planetary gear stage 112 axially displaceably. Impact deactivation clutch 132 is situated between first planetary gear stage 110 and second planetary gear stage 112. Impact deactivation clutch 132 has a first clutch element 134 which is always rotatably coupled to a part of hammer mechanism 22. First clutch element 134 is rotatably fixedly connected to planet carrier 120 of first planetary gear stage 110. First clutch element 134 is designed in one piece with planet carrier 120 of first planetary gear stage 110. Impact deactivation clutch 132 has a second clutch element 136 which is always rotatably coupled to a part of transmission 26. Second clutch element 136 is rotatably fixedly connected to connecting means 124. Second clutch element 136 is designed in one piece with connecting means 124. Planet carrier 126 of second planetary gear stage 112 is rotatably fixedly connected to second clutch element 136. During the illustrated hammer drilling operation, impact deactivation clutch 132 is engaged. During the hammer drilling operation, tool spindle 40 transfers an axial clutch force to impact deactivation clutch 132 when the operator pushes the insert tool against a workpiece. The clutch force engages impact deactivation clutch 132. When the operator removes the insert tool from the workpiece, an impact activation spring 140 of impact deactivation device 24 disengages impact deactivation clutch 132.

Transfer means 128 are designed as bars. Control element 130 supports tool guiding unit 20 in a direction against impact direction 66 during a screw-driving and drilling mode. A force which is applied to tool guiding unit 20 acts via bearing means 44, another transfer means 142 of impact deactivation device 24, and transfer means 128, which are designed as bars, on supporting surfaces 144 of control element 130. This prevents clutch elements 134, 136 from engaging during screw-driving and drilling mode. The other transfer means 142 is essentially star-shaped and has a ring-disk-shaped central area. Control element 130 has three recesses 146. In the illustrated hammer drilling operation, transfer means 128 are inserted into recesses 146, whereby tool guiding unit 20 is axially movable in the hammer drilling mode.

Connecting means 128 is operatively situated between planet carrier 126 of second planetary gear stage 112 and tool spindle 40. In addition, connecting means 128 has second clutch element 136 of impact deactivation clutch 132. Connecting means 128 is axially displaceably supported against impact activation spring 140. By axially displacing connecting means 128 in the direction of insert tool holding fixture 38, impact deactivation clutch 132 is disengaged. Connecting means 128 is always rotatably fixedly and axially displaceably connected to tool spindle 40. In this way, planet carrier 126 of second planetary gear stage 112 remains rotatably coupled with tool spindle 40 even in the case of an impact. Planet carrier 126 of second planetary gear stage 112 is rotatably fixedly connected to connecting means 128. Planet carrier 126 of second planetary gear stage 112 and connecting means 128 are axially displaceably connected in relation to one another.

Figure 12:
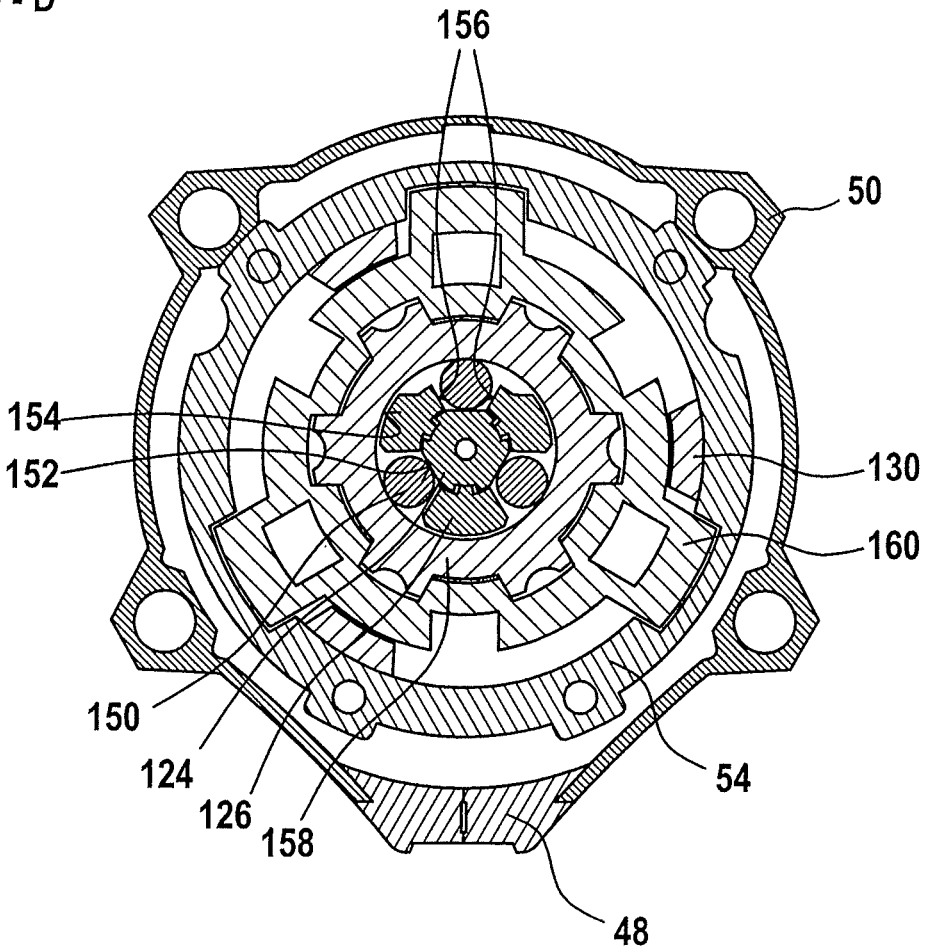
FIG. 12 shows a section area D through a spindle blocking device of the hand tool device from FIG. 1.

FIG. 12 shows a section area D of spindle blocking device 36. Spindle blocking device 36 is provided for rotatably fixedly connecting tool spindle 40 to hand tool housing 14 when a tool torque is applied to insert tool holding fixture 38, e.g., when an insert tool is clamped into insert tool holding fixture 38. Spindle blocking device 36 is designed partially in one piece with connecting means 128 and planet carrier 126 of second planetary gear stage 112. Spindle blocking device 36 has blocking means 150, first clamping areas 152, a second clamping area 154, and free-wheel areas 156. Blocking means 150 have a cylindrical design. First clamping areas 152 are designed as areas of a surface of connecting means 128. First clamping areas 152 are designed to be planar. Second clamping area 154 is designed as an inner surface of a clamping means 158 of spindle blocking device 36.

Clamping means 158 is designed as a clamping ring. Clamping means 158 is rotatably fixedly connected to hand tool housing 14, namely to hammer mechanism housing 56 of hand tool housing 14, via a component of spindle blocking device 36. Here, clamping means 158 is rotatably fixedly connected to hand tool housing 14 via a stop means 160 of spindle blocking device 36. Free-wheel areas 156 are designed as areas of a surface of planet carrier 126 of second planetary gear stage 112. When a tool torque is applied to insert tool holding fixture 38, blocking means 150 clamp between first clamping areas 152 and second clamping area 154. When drive unit 30 drives, free-wheel areas 156 guide blocking means 150 on a circular trajectory and prevent them from clamping. Planet carrier 126 of second planetary gear stage 112 and connecting means 128 are meshed with one another having clearance. Spindle blocking device 36 is situated outside of transmission housing 52. Spindle blocking device 36 is situated inside of hammer mechanism housing 56.

Torque limiting unit 34 is provided to limit in a screw-driving mode a tool torque which is output maximally by insert tool holding fixture 38. Torque limiting unit 34 includes stop means 160, an operating element 162, adjusting elements 164, limiting springs 166, a transfer means 168, first stop areas 170, a second stop area 172, and limiting means 174. Transfer means 168, first stop areas 170, and second stop area 172 form a clutch of torque limiting unit 34. With the aid of operating element 162, a torque which is maximally transferable to insert tool holding fixture 38 may be limited. Operating element 162 has a circular design. Operating element 162 has a two-shell design. It joins insert tool holding fixture 38 in the direction of transmission 26. Operating element 162 has oblique setting areas 176 which act on adjusting elements 164 in the axial direction. Adjusting elements 164 are supported rotatably fixed and axially displaceable by operating element 162. A rotation of operating element 162 displaces adjusting elements 164 in the axial direction.

Limiting springs 166 are supported on one side on adjusting element 164. Limiting springs 166 are supported on the other side at stop means 160 of torque limiting unit 34 via transfer means 168. Transfer means 168 are displaceably supported in the axial direction. A surface of stop means 160 has first stop areas 170. In the screw-driving mode, stop means 160 is supported movably in the axial direction against limiting springs 166.

Figure 13:
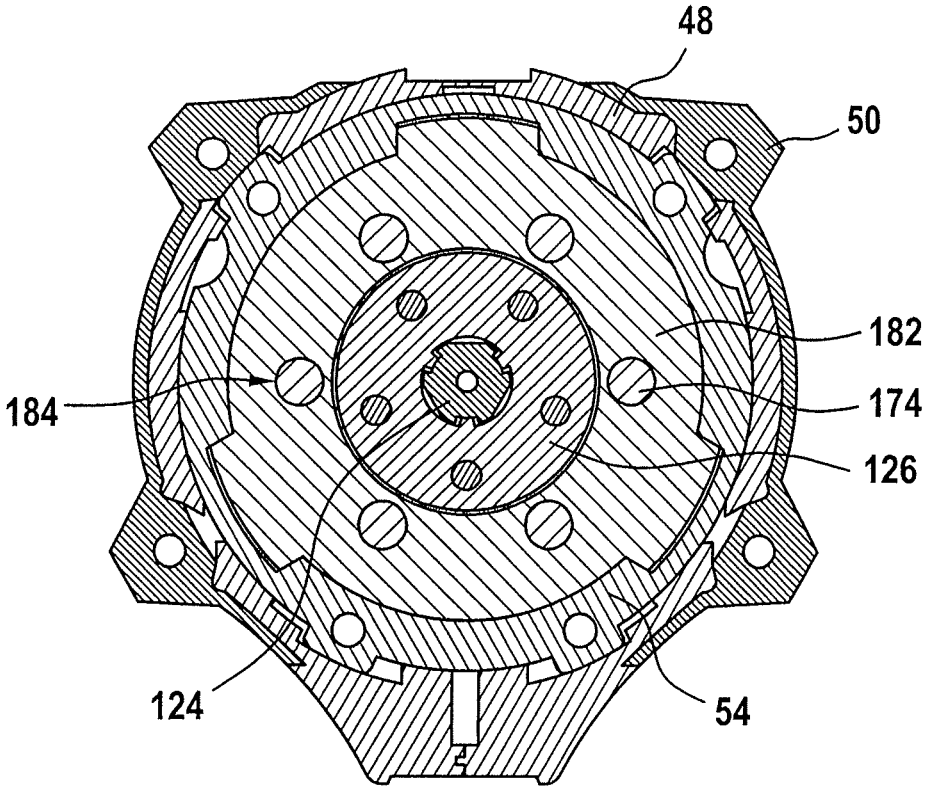
FIG. 13 shows a section area E through a limiting and guiding means of the spindle blocking device of the hand tool device from FIG. 1.

Second stop area 172 is designed as an area of a surface of an annulus gear 178 of second planetary gear stage 112. Second stop area 172 delimits trough-shaped recesses 180. Limiting means 174 have a spherical design. Torque limiting unit 34 has a limiting and guiding means 182 which is provided to axially displaceably support limiting means 174. FIG. 13 shows a section area E of limiting and guiding means 182. Limiting and guiding means 182 delimits recesses 184 in which limiting means 174 are supported displaceably in impact direction 66. Recesses 184 have a tubular design. Hammer mechanism transmission housing 54 rotatably fixedly holds limiting and guiding means 182. During a screw-driving operation, limiting means 174 are situated in trough-shaped recesses 180. Here, limiting means 174 rotatably fixedly hold annulus gear 178 of second planetary gear stage 112. Upon reaching the set maximum tool torque, limiting means 174 press stop means 160 away against limiting springs 166. Subsequently, limiting means 174 each jump into a next of trough-shaped recesses 180. Annulus gear 178 of second planetary gear stage 112 rotates in the process, thus interrupting the screw-driving operation.

Torque limiting unit 34 has deactivation means 186, 188 which are provided to deactivate a torque limitation of torque limiting unit 34, whereby a maximum torque is a function of a maximum torque of drive unit 30. Adjusting element 164 and transfer means 168 each have a part of deactivation means 186, 188. Deactivation means 186, 188 prevent an axial movement of stop means 160 at least during a drilling mode. Deactivation means 186, 188 are designed as pillar-shaped moldings to adjusting element 164 and transfer means 168, respectively. Deactivation means 186, 188 extend toward one another. Deactivation means 186, 188 are operatively oriented in parallel to limiting springs 166. In a drilling position of operating element 162 of torque limiting unit 34, deactivation means 186, 188 prevent an axial displacement of stop means 160. In this case, adjusting element 164 is displaced in the direction of transfer means 168 far enough for deactivation means 186, 188 to make contact.

Figure 14:
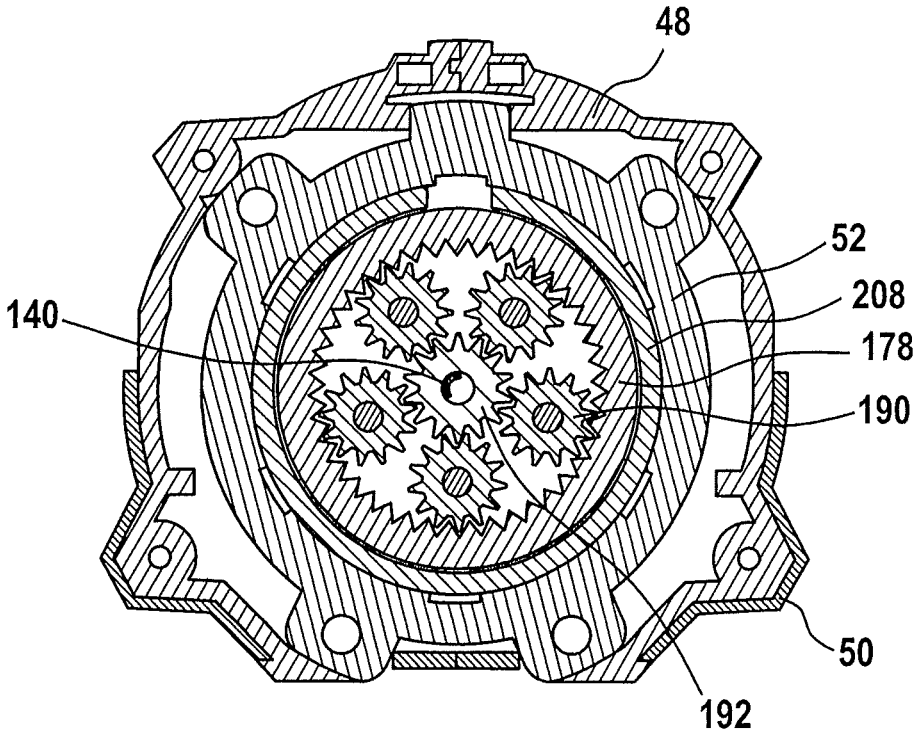
FIG. 14 shows a section area F through a second planetary gear stage of the hand tool device from FIG. 1.

FIG. 14 shows a section area F of second planetary gear stage 112. Annulus gear 178 of second planetary gear stage 112 is supported in hand tool housing 14 in such a way that it is prevented from completing a rotation at least during a drilling operation. Planetary wheels 190 of second planetary gear stage 112 mesh with annulus gear 178 and a sunwheel 192 of second planetary gear stage 112.

Figure 15:
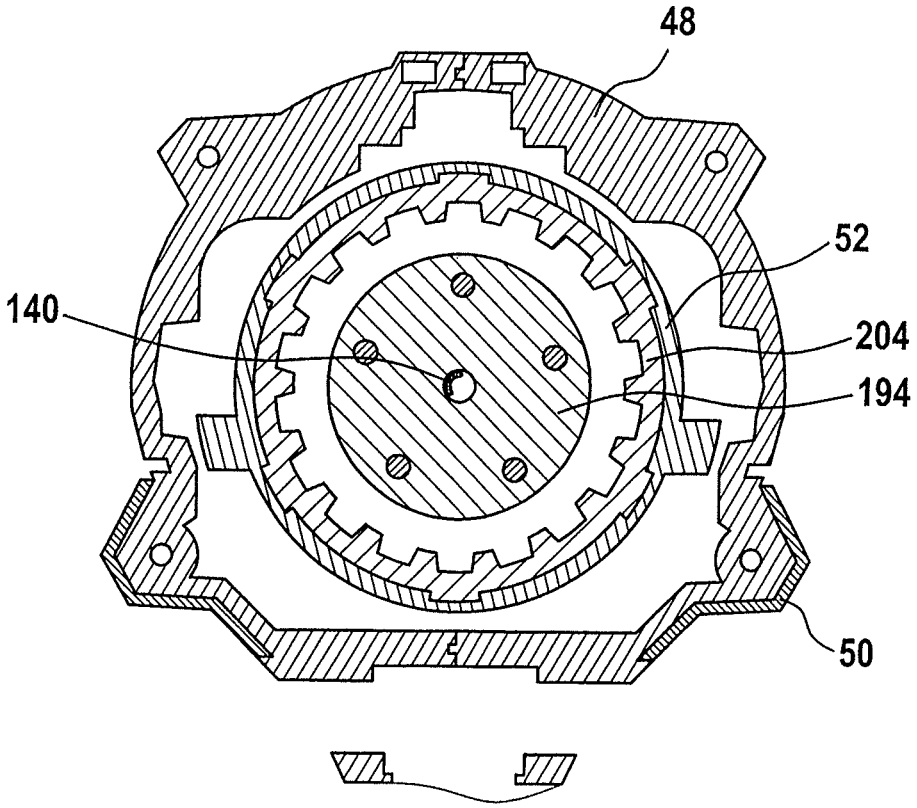
FIG. 15 shows a section area G through a planet carrier of a third planetary gear stage of the hand tool device from FIG. 1.
Figure 16:
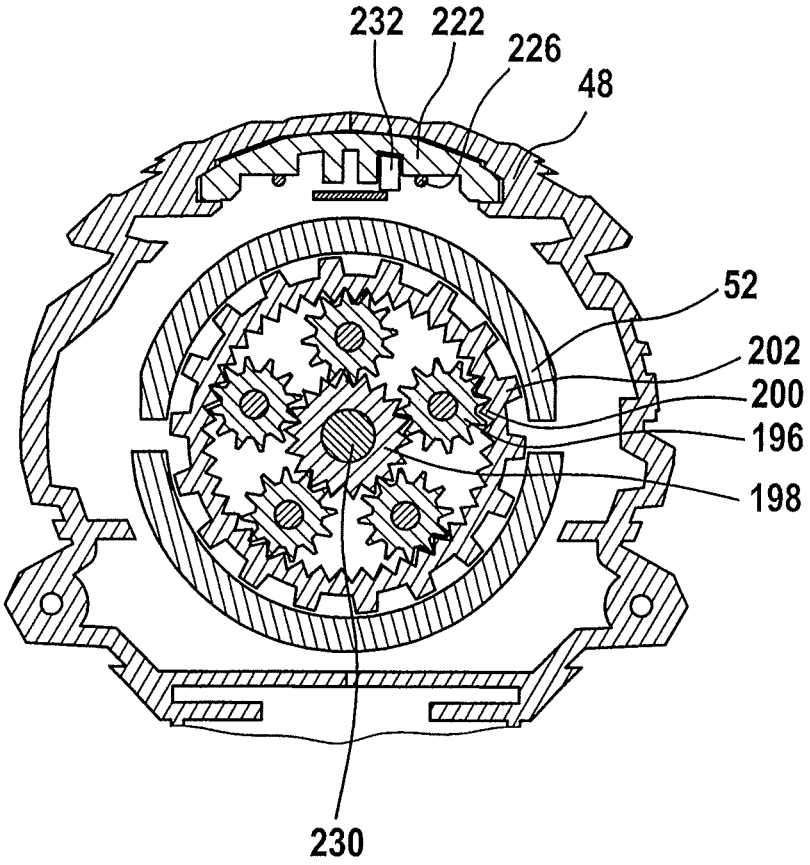
FIG. 16 shows a section area H through planetary wheels of the third planetary gear stage of the hand tool device from FIG. 15.

FIG. 15 shows a section area G through a planet carrier 194 of third planetary gear stage 114. FIG. 16 shows a section area H through planetary wheels 196 of third planetary gear stage 114. Sunwheel 192 of second planetary gear stage 112 is rotatably fixedly connected to planet carrier 194 of third planetary gear stage 114. Planetary wheels 196 of third planetary gear stage 114 mesh with a sunwheel 198 and an annulus gear 200 of third planetary gear stage 114.

Annulus gear 200 of third planetary gear stage 114 has a toothing 202 which rotatably fixedly connects annulus gear 200 of third planetary gear stage 114 to hand tool housing 14 in a first gear ratio. Toothing 202 of annulus gear 200 of third planetary gear stage 114 engages in a first gear ratio with an internal toothing of a ring 204 which, in turn, is rotatably fixedly connected to hand tool housing 14.

Between second planetary gear stage 112 and third planetary gear stage 114, a supporting means 206 is situated which is provided to deflect a force to hand tool housing 14, this force acting axially on annulus gear 200 of third planetary gear stage 114 and being in particular caused by torque limiting unit 34. Supporting means 206 is designed in the shape of an annular disk. Supporting means 206 is connected via ring 204 in a form-locked manner to hand tool housing 14 in an axial direction pointing away from insert tool holding fixture 38. A snap ring 208 holds supporting means 206 in an axial direction pointing toward insert tool holding fixture 38.

Figure 17:
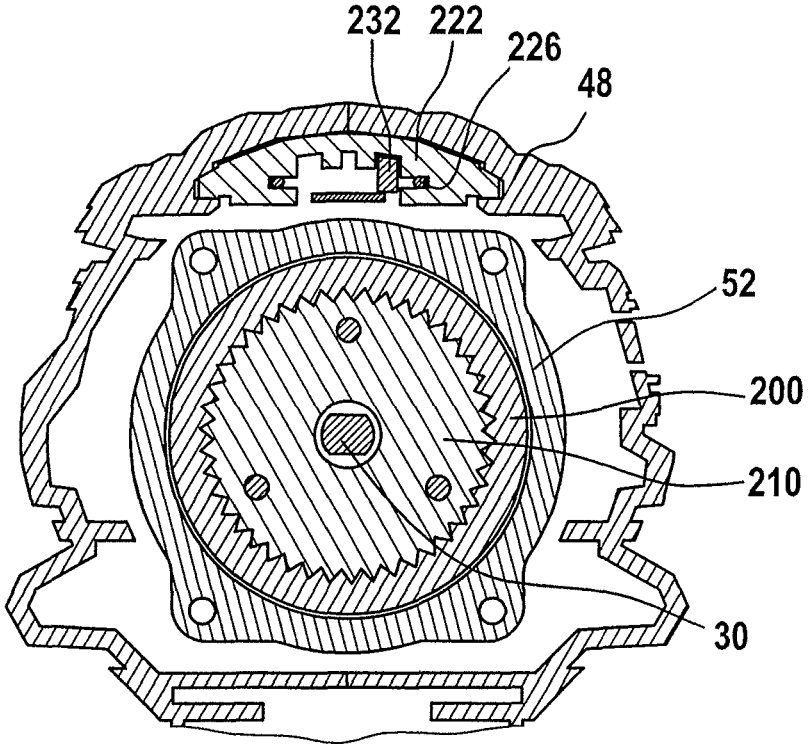
FIG. 17 shows a section area I through a planet carrier of a fourth planetary gear stage of the hand tool device from FIG. 1.
Figure 18:
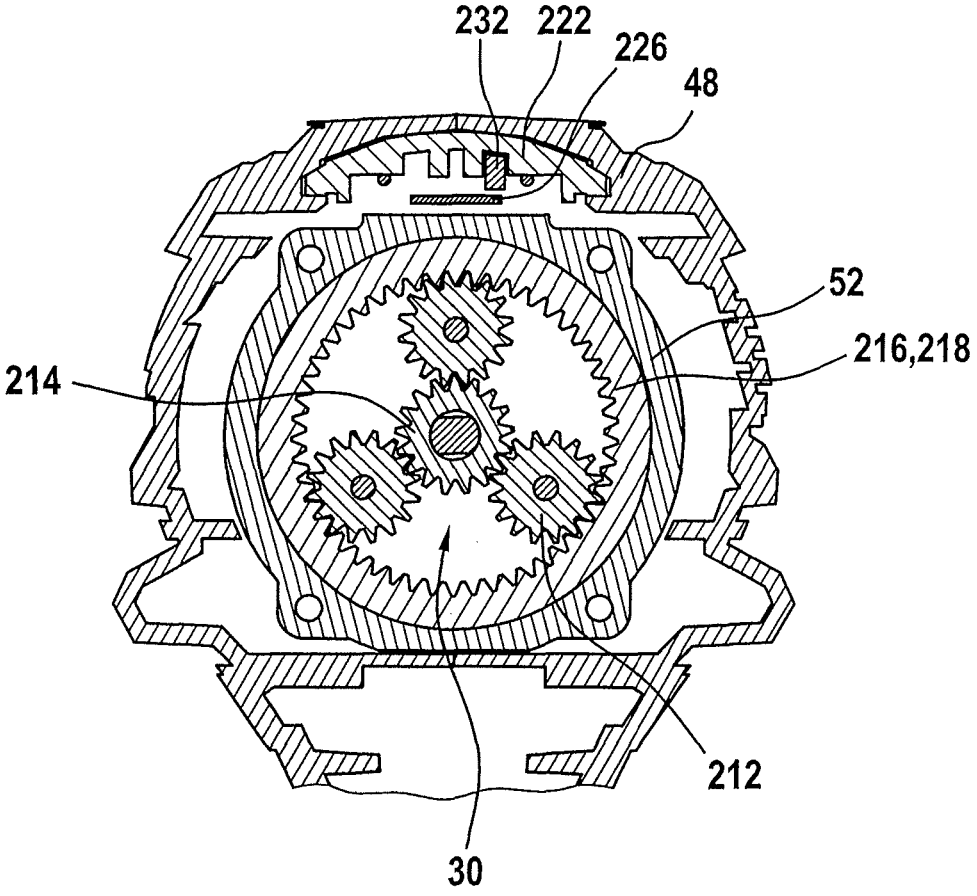
FIG. 18 shows a section area J through planetary wheels of the fourth planetary gear stage of the hand tool device from FIG. 17.

FIG. 17 shows a section area I through a planet carrier 210 of fourth planetary gear stage 116. FIG. 18 shows a section area J through planetary wheels 212 of fourth planetary gear stage 116. Sunwheel 198 of third planetary gear stage 114 is rotatably fixedly connected to planet carrier 210 of fourth planetary gear stage 116. Planetary wheels 212 of fourth planetary gear stage 116 mesh with a sunwheel 214 and an annulus gear 216 of fourth planetary gear stage 116. Annulus gear 216 of fourth planetary gear stage 116 is rotatably fixedly connected to hand tool housing 14. Annulus gear 216 of fourth planetary gear stage 116 is designed in one piece with a transmission housing cover 218 which faces away from insert tool holding fixture 38. Transmission housing cover 218 may be designed in one piece with transmission housing 52, but is implemented separately in this case. Transmission housing cover 218 is connected to transmission housing 52 prior to equipping transmission housing 52 with transmission 26. Sunwheel 214 of fourth planetary gear stage 116 is rotatably fixedly connected to a rotor 220 of drive unit 30.

Annulus gear 200 of third planetary gear stage 114 is supported displaceably in the axial direction, as shown in FIG. 2. In the first gear ratio, annulus gear 200 of third planetary gear stage 114 is rotatably fixedly connected to hand tool housing 14. In the second gear ratio, annulus gear 200 of third planetary gear stage 114 is rotatably fixedly connected to planet carrier 210 of fourth planetary gear stage 116 and rotatably supported in relation to hand tool housing 14. For this purpose, planet carrier 210 of fourth planetary gear stage 116 has an external toothing. This results in a reduction gear ratio of the first gear ratio between rotor 220 of drive unit 30 and planet carrier 194 of third planetary gear stage 114 being greater than a reduction gear ratio of the second gear ratio. Thus, insert tool holding fixture 38 rotates at a maximum speed of drive unit 30 more slowly in the case of the first gear ratio than in the case of the second gear ratio. A torque which is maximally achievable by drive unit 30 at insert tool holding fixture 38 is greater in the case of the first gear ratio than in the second gear ratio. A torque which is maximally achievable by drive unit 30 at insert tool holding fixture 38 is 40 Nm in the first gear ratio. A torque which is maximally achievable by drive unit 30 at insert tool holding fixture 38 is 14 Nm in the second gear ratio.

Transmission housing cover 218 is formed from plastic. Transmission housing cover 218 closes transmission housing 52 on the side facing away from insert tool holding fixture 38. Torque limiting unit 34 is provided to close the side of transmission housing 52, which faces insert tool holding fixture 38, in an operationally ready state. Hammer mechanism transmission housing 54 holds at transmission housing 52 the component of torque limiting unit 34 which closes the side of transmission housing 52, which faces insert tool holding fixture 38, in an operationally ready state. Limiting and guiding means 182 of torque limiting unit 34 closes the side of transmission housing 52, which faces insert tool holding fixture 38, in an operationally ready state. Limiting and guiding means 182 is formed from a metallic material. Transmission housing 52 is equipped on a side which faces insert tool holding fixture 38 with at least the second, the third, and the fourth planetary gear stage 112, 114, 116 of transmission 26.

Operating device 32 has a first operating element 222 and a second operating element 224. First operating element 222 is situated on a side of hand tool housing 14 which faces away from handle 18. It is movably supported in parallel to the axial direction of transmission 26. First operating element 222 is connected in the axial direction to annulus gear 200 of third planetary gear stage 114 via an adjusting means 226 of operating device 32. Annulus gear 200 of third planetary gear stage 114 has a groove 228 which engages adjusting means 226. In this way, annulus gear 200 of third planetary gear stage 114 is connected in an axial direction to adjusting means 226 in such a way that it is axially rotatable in relation to adjusting means 226. Adjusting means 226 has an elastic design, whereby the gear ratio of a rotational position of annulus gear 200 of third planetary gear stage 114 may be independently adjusted. When first operating element 222 is shifted in the direction of insert tool holding fixture 38, the first gear ratio is set. When first operating element 222 is shifted away from insert tool holding fixture 38, the second gear ratio is set.

Second operating element 224 is situated on a side of hand tool housing 14, which faces away from handle 18. Second operating element 224 is situated in such a way that it is displaceable about an axis which is oriented in parallel to the axial direction of transmission 26. Second operating element 224 mechanically activates or deactivates the hammer drilling mode upon operation. Second operating element 224 is rotatably fixedly connected to control element 130 of hand tool device 12. The screw-driving and drilling mode as well as the hammer drilling mode are settable with the aid of second operating element 224. When second operating element 224 is shifted to the left, viewed in impact direction 66, the hammer drilling mode is set. When second operating element 224 is shifted to the right, viewed in impact direction 66, the screw-driving and drilling mode is set.

Impact activation spring 140 of hand tool device 12 disengages impact deactivation clutch 132 during a hammer drilling operation, when the operator removes the insert tool from the workpiece. Impact activation spring 140 is situated coaxially to planetary gear stages 110, 112, 114, 116 of transmission 26. Second planetary gear stage 112 and third planetary gear stage 114 each enclose impact activation spring 140 at least on one plane which is oriented vertically to the axial direction of transmission 26. Connecting means 128 supports impact activation spring 140 on a side which faces insert tool holding fixture 38. A bearing means 230 supports impact activation spring 140 on a side which faces away from insert tool holding fixture 38. Bearing means 230 is designed as a sphere. Bearing means 230 is situated between impact activation spring 140 and rotor 220 of drive unit 30.

Hand tool device 12 has a first detection unit 232 and a second detection unit 234. First detection unit 232 is provided to electrically output a characteristic which is a function of whether hammer mechanism 22 is activated, i.e., in the hammer drilling mode, or deactivated, i.e., in the drilling and screw-driving mode. First detection unit 232 is designed as a switch which detects a movement of second operating element 224 in relation to hand tool housing 14. Alternatively, detection unit 232 might also detect a movement of another part of hammer mechanism 22 which appears reasonable to those skilled in the art.

Second detection unit 234 is provided to electrically output a second characteristic which is a function of which one of the gear ratios of transmission 26 is set with the aid of first operating element 222. First detection unit 234 is designed as a switch which detects a movement of first operating element 222 in relation to hand tool housing 14. Alternatively, detection unit 232 might also detect a movement of another part of transmission 26 which appears reasonable to those skilled in the art.

Hand tool device 12 has a control unit 236 which is provided to control drive unit 30 during operation. Control unit 236 includes a microcontroller and a power electronic device. The power electronic device is provided to energize drive unit 30 for differing speeds and/or differing torques. The microcontroller is provided to control drive unit 30 via the power electronic device as a function of the first characteristic and the second characteristic. Control unit 236 includes a protective function which is provided to delimit a torque which is maximally output by drive unit 30 during the operating mode, when the hammer drilling mode is activated and the first gear ratio is set, i.e., a low maximum speed and a high maximum torque. In this case, control unit 236 delimits an electric current which is maximally output to drive unit 30.

Hand tool device 12 has a hammer mechanism spindle bearing means 238 on which hammer mechanism spindle 60 is rotatably supported on the side which faces away from insert tool holding fixture 38. Hammer mechanism spindle bearing means 238 is fixedly connected in the axial direction to hammer mechanism spindle 60, in particular hammer mechanism spindle bearing means 238 is press-molded with hammer mechanism spindle 60. Additionally or advantageously alternatively, hammer mechanism spindle bearing means 238 might be fixedly connected in the axial direction to hand tool housing 14.

Hand tool device 12 has a hammer mechanism spindle fastening means 242 which is provided for fastening hammer mechanism spindle 60 in the axial direction. Hammer mechanism spindle fastening means 242 is designed as a snap ring. Hammer mechanism spindle fastening means 242 engages a groove 240 of hammer mechanism spindle 60. Groove 240 of hammer mechanism spindle 60 is situated on the side of hammer mechanism spindle 60 which faces away from insert tool holding fixture 38.

In an operationally ready state, hammer mechanism spindle fastening means 242 is situated in the axial direction between hammer mechanism spindle bearing means 238 and first planetary gear stage 110. Hammer mechanism spindle fastening means 242 holds hammer mechanism spindle 60 in the axial direction in a form-locked manner. Alternatively, hammer mechanism spindle 60 may be fastened in the axial direction in a different way which appears reasonable to those skilled in the art. For example, hammer mechanism spindle bearing means 238 might be connected in the axial direction to hammer mechanism spindle 60 integrally or in a force-fitted manner.

What is claimed is:

1. A hand tool device, comprising:

a hammer mechanism including a hammer, at least one curve guide which drives the hammer at least during a hammer drilling operation, and at least one hammer mechanism spring which (i) stores at least a part of an impact energy in at least one operating state, and (ii) holds the hammer in the peripheral direction in at least one operating state, wherein the hammer mechanism spring holds the hammer in a case of a clockwise rotation in the peripheral direction, in which a tool spindle and/or an insert tool holding fixture, viewed in an impact direction, is driven clockwise, wherein the hammer has at least a free wheel during a counterclockwise rotation, in which the tool spindle and/or the insert tool holding fixture, viewed in the impact direction, is driven counterclockwise.

2. The hand tool device as recited in claim 1, wherein the hammer has a catching arrangement on which the hammer mechanism spring acts in the case of a clockwise rotation in the peripheral direction.

3. The hand tool device as recited in claim 2, wherein the catching arrangement and the hammer mechanism spring are connected in a form-locked manner during the clockwise rotation in the peripheral direction.

4. The hand tool device as recited in claim 2, wherein the hammer has at least one part of the curve guide.

5. The hand tool device as recited in claim 2, wherein the tool spindle has at least one bearing surface on which the hammer is supported movably in at least one operating state.

6. The hand tool device as recited in claim 2, wherein the hammer mechanism includes a hammer mechanism spindle having a bearing surface on which the hammer is supported movably in at least one operating state.

7. The hand tool device as recited in claim 5, wherein the tool spindle has at least one impact surface which the hammer strikes at least during the hammer drilling operation.

8. The hand tool device as recited in claim 2, wherein the hand tool device is part of a hammer combi drill.

9. The hand tool device as recited in claim 2, wherein the catching arrangement is configured to catch the hammer from an initial rotary motion during the clockwise rotation and to establish a rotatably fixed connection.

10. The hand tool device as recited in claim 1, wherein the hammer has a collar extending radially from a basic body of the hammer, the collar having a substantially circular surface which supports the hammer mechanism spring.

11. The hand tool device as recited in claim 10, wherein the catching arrangement includes a ratchet surface which is oriented substantially perpendicularly to the surface which supports the hammer mechanism spring.

12. The hand tool device as recited in claim 10, wherein the surface is tilted relative to the impact direction to build a ramp.

13. The hand tool device as recited in claim 11, wherein, in the case of the clockwise rotation, the hammer mechanism spring acts on the ratchet surface and connects the hammer and the hammer mechanism spring in a form-locked manner.

14. The hand tool device as recited in claim 11, wherein, in the case of the counterclockwise rotation, the hammer mechanism spring slides over the ratchet surface such that the hammer and the hammer mechanism spring have a free wheel with respect to one another.

* * * * *